US008893695B2

(12) United States Patent
Liao

(10) Patent No.: US 8,893,695 B2
(45) Date of Patent: Nov. 25, 2014

(54) TOY GUN HAVING FIRE-CONTROL ASSEMBLY

(75) Inventor: Yin-Hsi Liao, New Taipei (TW)

(73) Assignee: Guay Guay Trading Co., Ltd., New Taipei (TW)

( * ) Notice: Subject to any disclaimer, the term of this patent is extended or adjusted under 35 U.S.C. 154(b) by 148 days.

(21) Appl. No.: 13/586,872

(22) Filed: Aug. 16, 2012

(65) Prior Publication Data

US 2014/0051328 A1 Feb. 20, 2014

(51) Int. Cl.
*F41B 7/00* (2006.01)
*F41B 11/00* (2013.01)

(52) U.S. Cl.
USPC ..... 124/27; 124/32; 124/40

(58) Field of Classification Search
USPC ..... 124/26, 27, 32, 40, 51.1, 66, 67
See application file for complete search history.

(56) References Cited

U.S. PATENT DOCUMENTS

| | | | | |
|---|---|---|---|---|
| 7,730,881 | B1 * | 6/2010 | Pedicini et al. | 124/65 |
| 7,878,184 | B2 * | 2/2011 | Klarborg | 124/65 |
| 8,118,016 | B2 * | 2/2012 | Italia et al. | 124/51.1 |
| 2006/0130822 | A1 * | 6/2006 | Jong | 124/51.1 |

* cited by examiner

*Primary Examiner* — John Ricci
(74) *Attorney, Agent, or Firm* — Leong C. Lei

(57) ABSTRACT

The toy gun contains a power element electrically connected with a driver element and an electronic fire-control assembly. The electronic fire-control assembly turns on or off the driver element, which in turn engages or disengages a gear set. When the trigger is pulled, the electronic fire-control assembly controls the power element to provide electricity to the driver element which in turn engages the gear set to conduct firing. The electronic fire-control assembly incorporates a magazine detection module, a shot selection module, and a trigger on/off module. When one of the functions breaks down, a user just replaces the electronic fire-control assembly, instead of spending time and effort to inspect, disassemble, and re-assemble the toy gun.

9 Claims, 7 Drawing Sheets

TOY GUN HAVING FIRE-CONTROL ASSEMBLY

TECHNICAL FIELD OF THE INVENTION

The present invention generally relates to toy or training guns, and especially relates to an electronic fire-control assembly for such a gun that can be quickly replaced.

DESCRIPTION OF THE PRIOR ART

There is a sizable market for toy guns as not only boys but also grown-ups would enjoy having a toy gun. The toy guns are of various varieties and types such as automatic, semi-automatic, single-shot, repeater, etc. There are also hand guns, rifles, machine guns, sniper rifles, etc. These various varieties and types can fit the needs of hobbyists of all ages.

Structurally, a toy gun contains various parts and mechanisms, each for a specific purpose jointly working together. Taking an automatic rifle as example, its motor, ratchets, trigger, etc. have to work harmoniously. When a part or mechanism is out of order, the toy gun has to be disassembled and the outside parts or mechanisms have to be removed sequentially to reach and replace the broken one. These steps are tedious and usually a single small broken part would cause a lot of time and trouble. It is also not uncommon that the toy guns after being dismantled cannot be put back together.

FIG. 1 is a sectional diagram showing a conventional toy gun. As illustrated, inside a toy gun 3, there are a number of gears 31, a trigger 32, and a mechanical control assembly 33, interacting with each other. When the trigger 32 is pulled, the mechanical control assembly 33 is engaged to drive the gears 31 into action so as the file the toy gun 3. As can be imagined, to replace a broken part in the toy gun 3, the time and effort for disassembly and re-assembly is tremendous.

SUMMARY OF THE INVENTION

A major objective of the present invention is to provide an electronic fire-control assembly that can control the mode, times, and the on/off of the trigger so as to achieve firing modes such as single-shot, single-shot-repeated-firing, repeated-firing, and having safety on. The electronic fire-control assembly can also detect whether there are bullets in the magazine or whether the magazine is plugged, so as to enhance the operation experience of the toy gun or training gun. A magazine detection module, a shot selection module, and a trigger on/off module are all housed in the electronic fire-control assembly. When one of the functions breaks down, a user just replaces the electronic fire-control assembly, instead of spending time and effort to inspect, disassemble, and re-assemble the toy gun.

To achieve the objective, a toy gun according to the present invention contains a power element electrically connected with a driver element and an electronic fire-control assembly. The electronic fire-control assembly turns on or off the driver element, which in turn engages or disengages a gear set. The electronic fire-control assembly also detects the presence of a magazine and responds accordingly. The toy gun also contains a trigger and a power conversion board electrically connected with the power element, the driver element, and the fire-control assembly. When the trigger is pulled, the electronic fire-control assembly is activated. The electronic fire-control assembly notifies the power conversion board which controls the power element to provide electricity to the driver element. The driver element engages the gear set to conduct firing. When there is no bullet in the magazine or the magazine is not plugged, the electronic fire-control assembly would detect the situation and turns off the power provision.

Through the invention, the problems of the prior arts that the toy gun has to be disassembled in great effort, inspected to find out the broken part, and that putting the gun back together would also encounter trouble are obviated.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
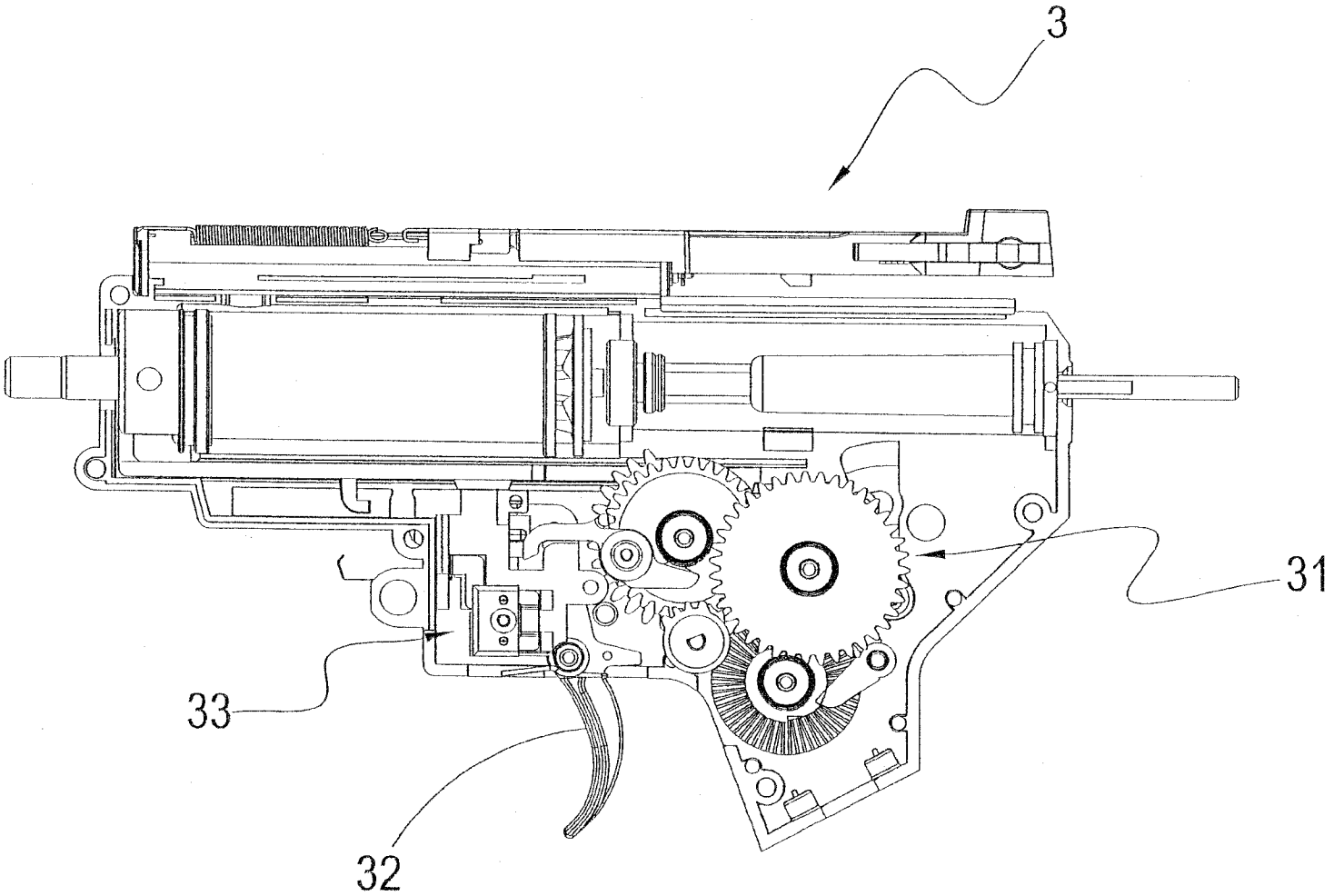
FIG. 1 PRIOR ART
FIG. 1 is a sectional diagram showing a conventional toy gun.
Figure 2:
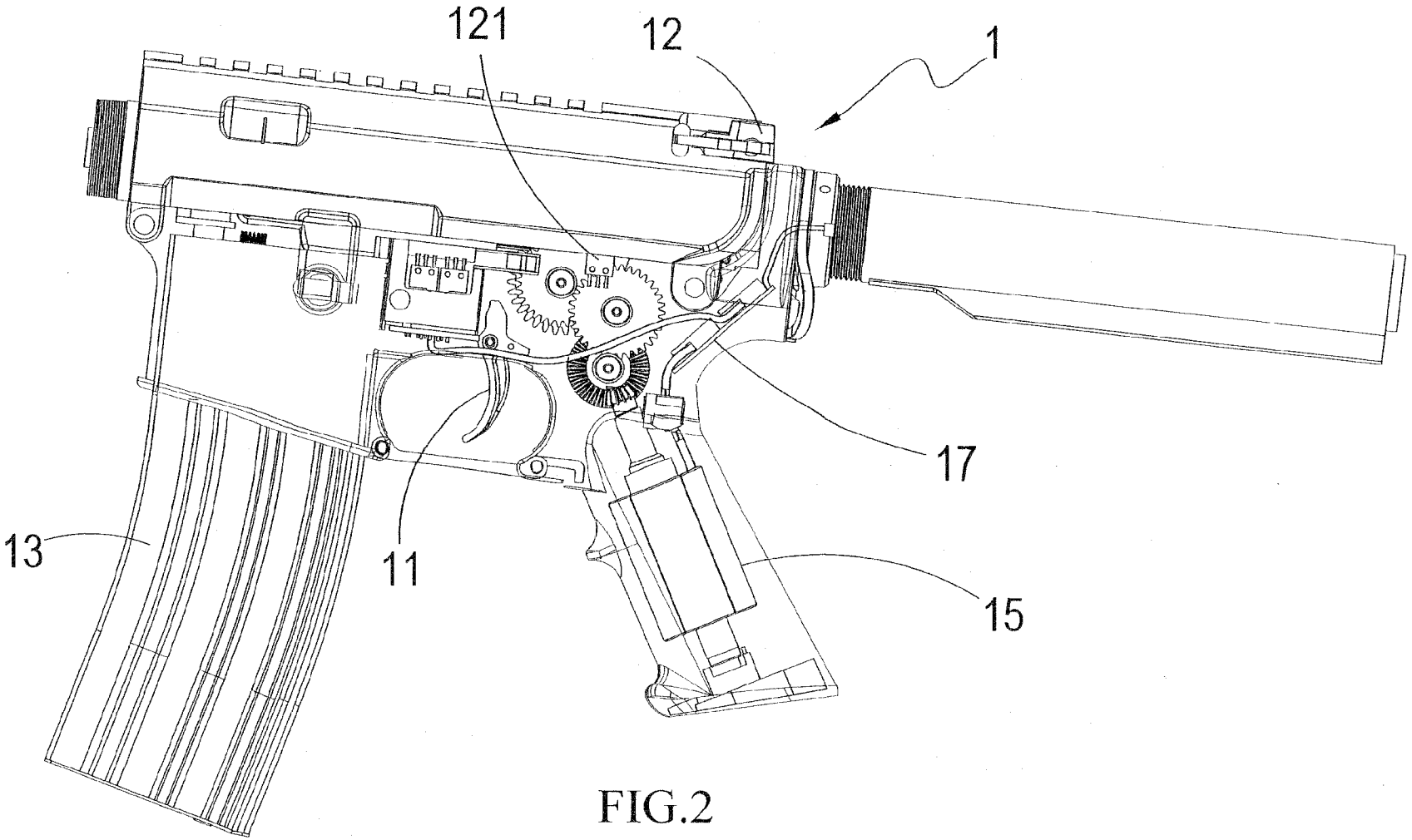
FIG. 2 is a sectional diagram showing a toy gun according to an embodiment of the present invention.
Figure 2A:
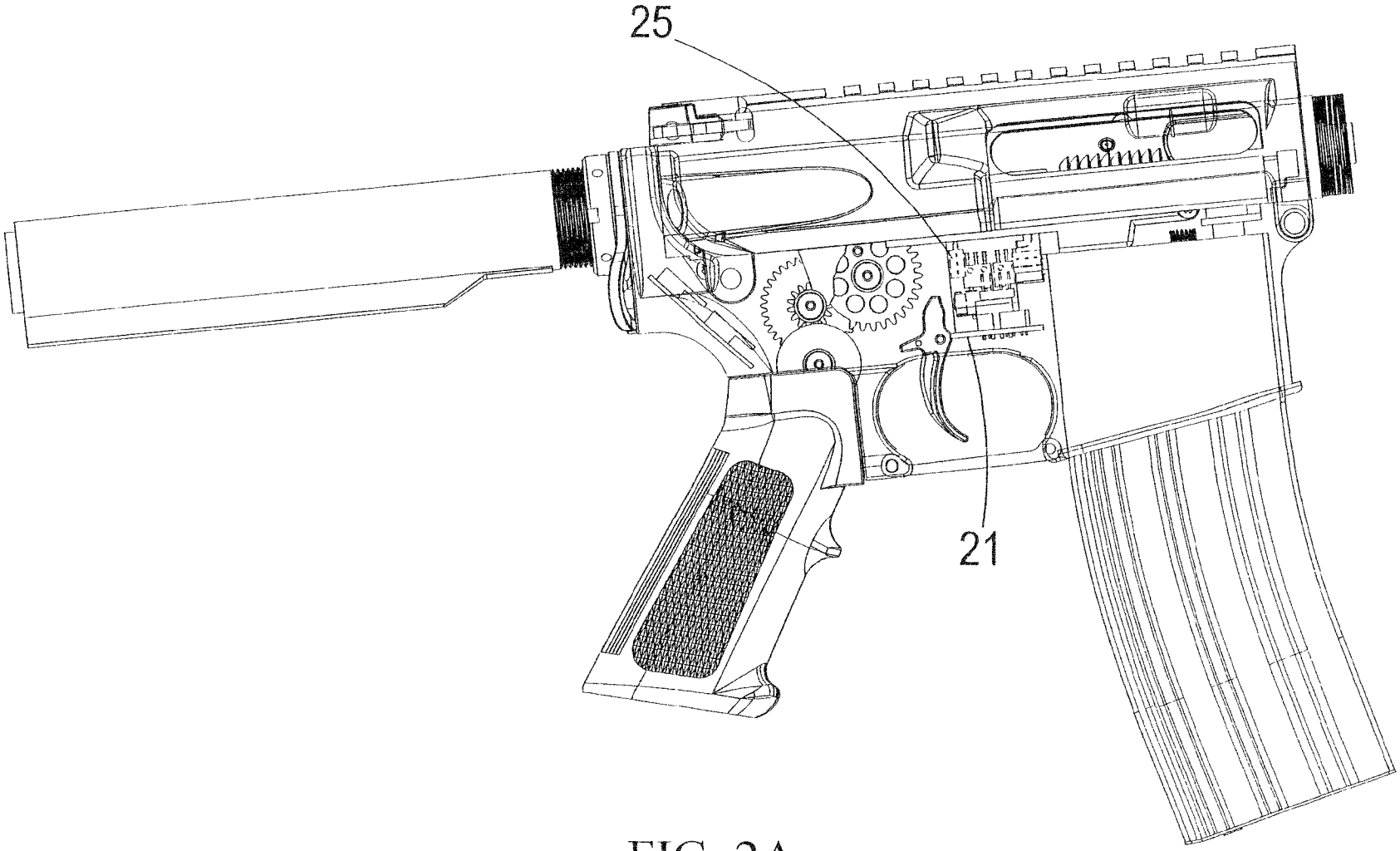
FIG. 2A is another sectional diagram showing a toy gun according to an embodiment of the present invention.
Figure 3:
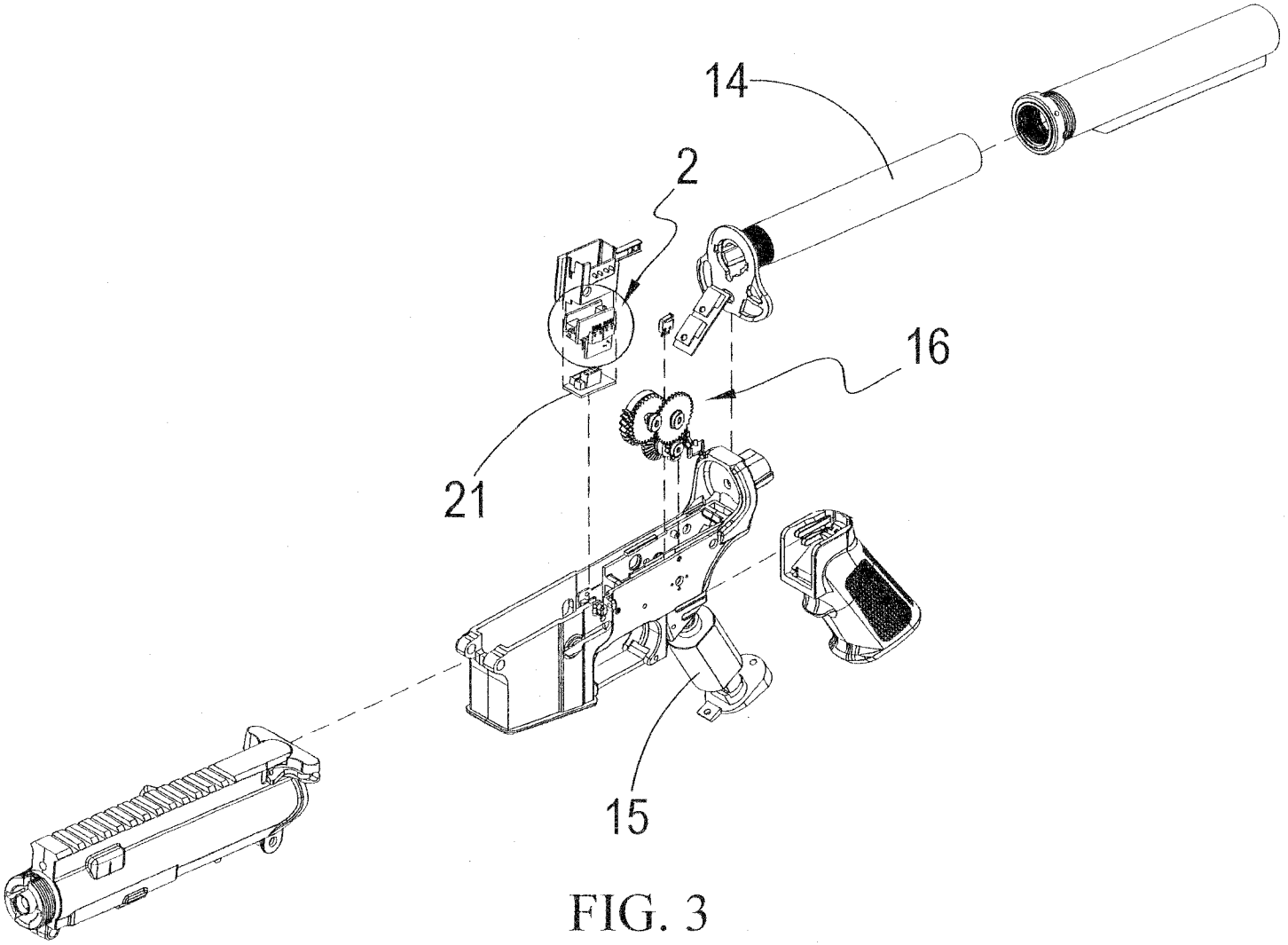
FIG. 3 is a perspective partially break-down diagram showing the toy gun of FIG. 2.
Figure 3A:
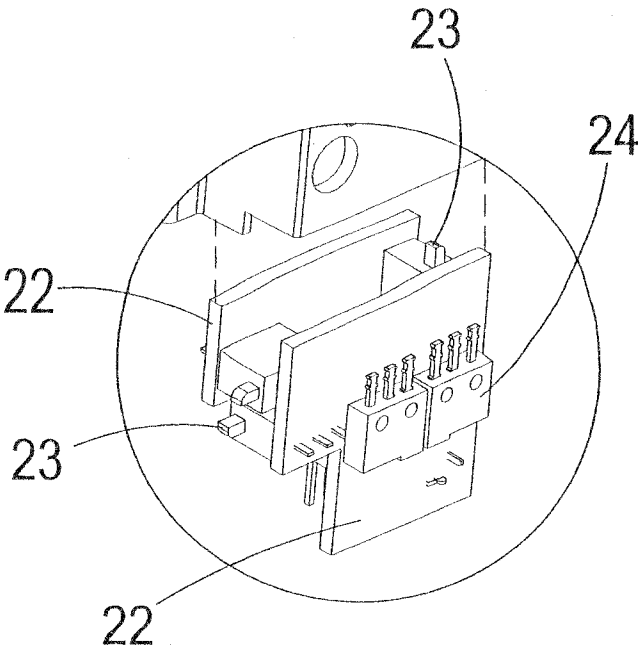
FIG. 3A is a perspective diagram showing a portion of the toy gun of FIG. 2.
Figure 4:
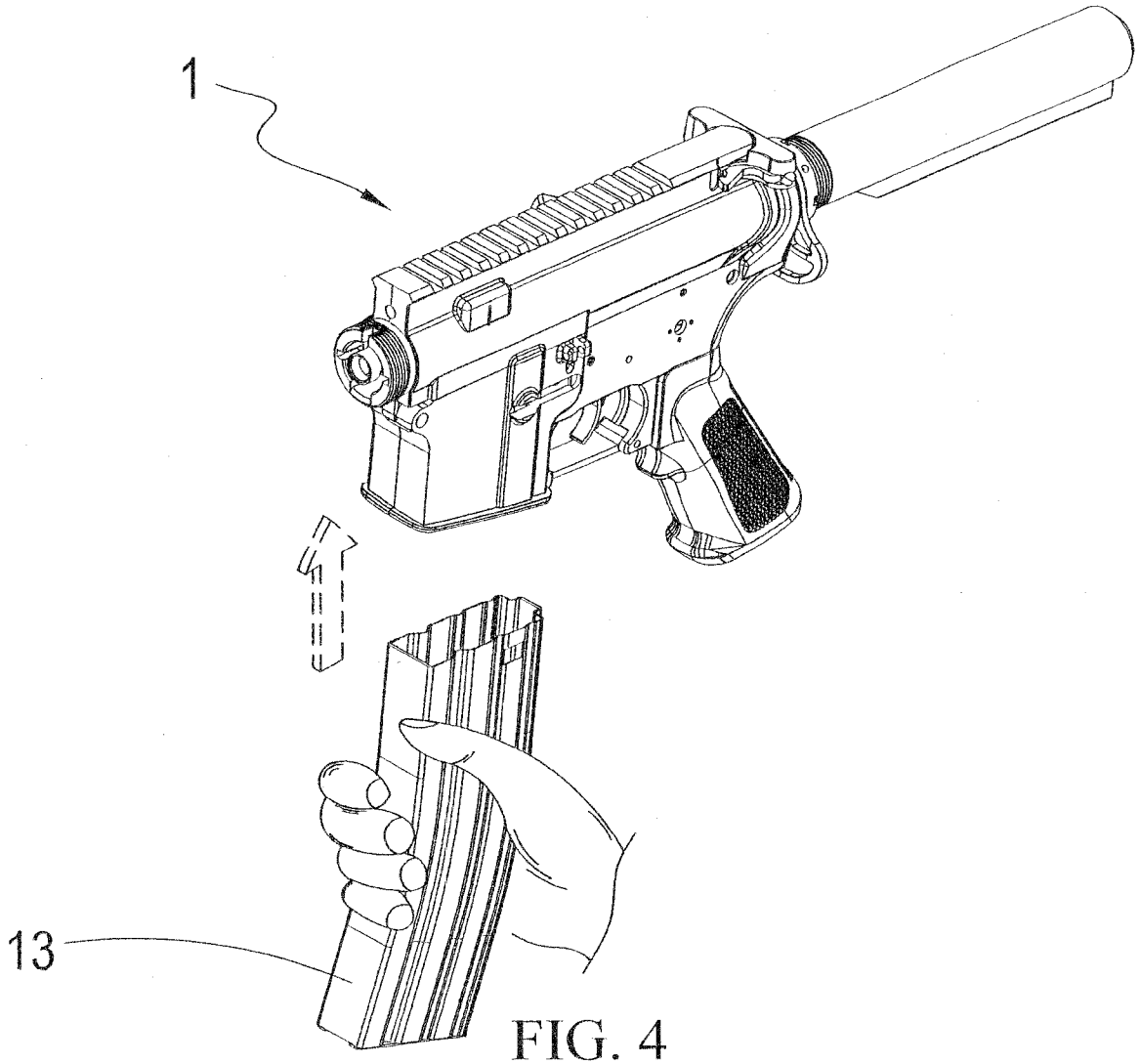
FIG. 4 is a perspective diagram showing a magazine being plugged into the toy gun of FIG. 2.
Figure 5:
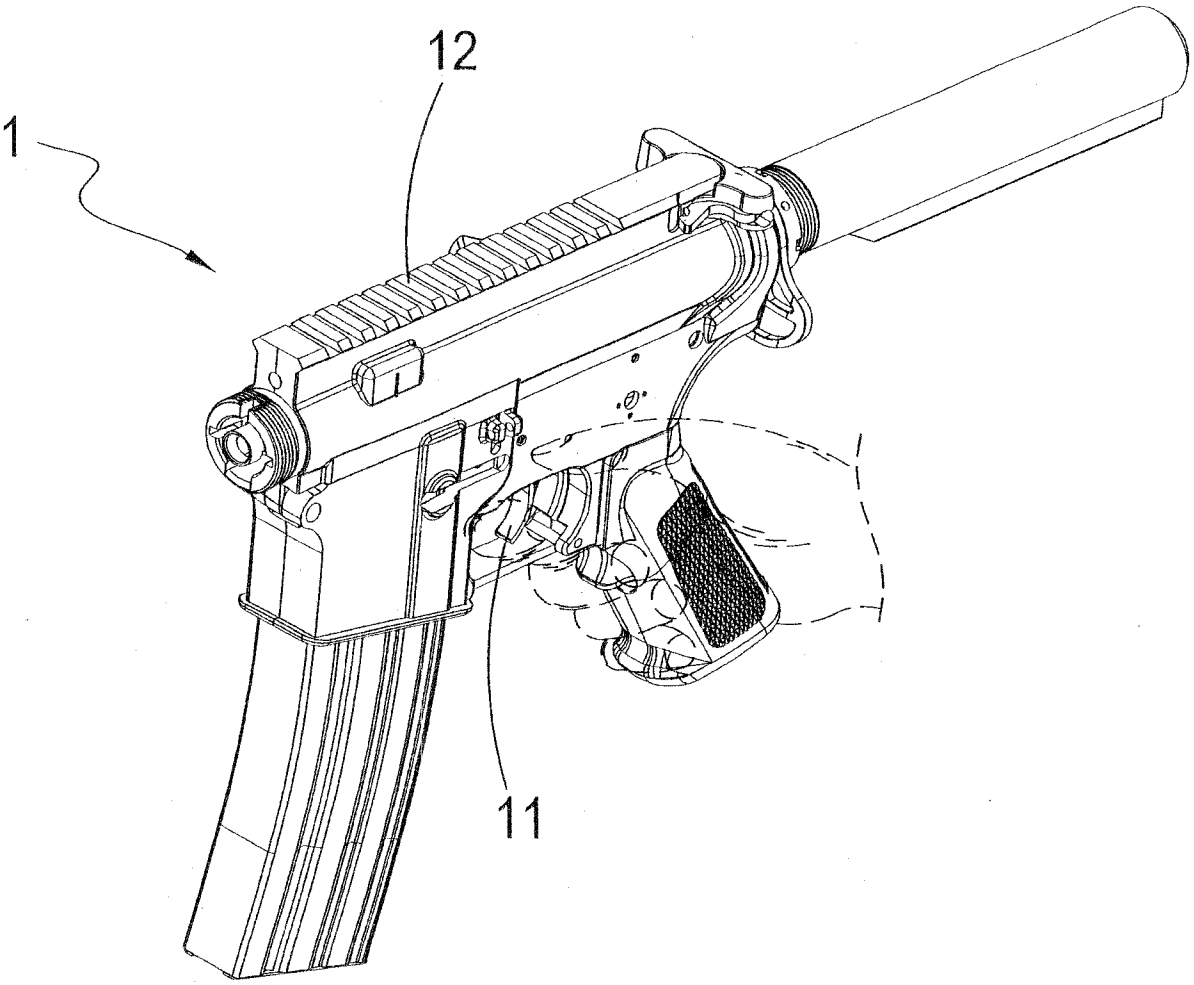
FIG. 5 is a perspective diagram showing the toy gun of FIG. 2 is held by hand.

As shown in FIGS. 2 and 3, a toy gun 1 according to an embodiment of the present invention mainly contains a trigger 11, a slide 12, a slide detection switch 121 for detecting the position of the slide 12, a magazine 13, a power element 14 which is a battery in the present embodiment, a driver element 15 which is a motor in the present embodiment and is electrically connected with the power element 14, a gear set 16 engaged by the driver element 15, an electronic fire-control assembly 2, and a power conversion board 17 electrically connected with the power element 14, the driver element 15, and the fire-control assembly 2. A sliding trough (not shown) inside the toy gun 1 is for the slidable configuration of the electronic fire-control assembly 2. A tenon (not shown) in the toy gun 1 is for locking the electronic fire-control assembly 2. The electronic fire-control assembly 2 is housed in the toy gun 1 and electrically connected with the power element 14. The electronic fire-control assembly 2 activates or turns off the driver element 15, which in turn engages or disengages the gear set 16.

The electronic fire-control assembly 2 is housed in an enclosure and contains a signal conversion board 21, at least a microprocessor 22 configured on the signal conversion board 21 which provides electricity to the microprocessor 22, at least a magazine detection module 23 configured in the microprocessor 22 for detecting the state of the magazine 13 and responding accordingly, at least a shot selection module 24 configured in the microprocessor 22, and a trigger on/off module 25 data-linked with the shot selection module 24 for interacting with the trigger 11.

The operation of the toy gun 1 is described as follows along with FIGS. 2 to 5. As illustrated, a large electrical current is provided by the power element 14 and is separated by the power conversion board 17 into two currents which are routed to the driver element 15 and the electronic fire-control assembly 2, respectively. The current routed to the electronic fire-control assembly 2 is a micro current for turning on and off of the electronic fire-control assembly 2. In addition, the toy gun 1 has an internal heat dissipation element (not shown) for releasing the heat produced by the electronic fire-control assembly 2. When the magazine 13 is plugged into the toy gun 1, the magazine detection module 23 detects the connection between the magazine 13 and the toy gun 1, and allows the electrical current to conduct through. On the other hand, the electrical current is blocked if the magazine 13 is not detected so as to simulate a real gun. Subsequently, when the slide 12 is pulled, the slide detection switch 121 detects the slide 12's being pulled and notifies the electronic fire-control assembly 2. Then, when the trigger 11 is pulled, the trigger on/off module 25 conducts firing in accordance with the selection of the shot selection module 24, and the firing action is initiated by the driver element 15 with the electricity provided by the power element 14, and through the gear set 16. Through the above described structures and steps, the electronic fire-control assembly 2 is capable of controlling and operating the toy gun 1.

The present invention has the following advantages.

Firstly, the electronic fire-control assembly 2 can control the shots fired and the on/off of the trigger 11. The electronic fire-control assembly 2 can also detect whether there are bullets in the magazine 13 or whether the magazine 13 is plugged, so as to enhance the operation experience of the toy gun or training gun. The magazine detection module 23, the shot selection module 24, and the trigger on/off module 25 are all housed in the electronic fire-control assembly 2. When one of the functions breaks down, a user just replaces the electronic fire-control assembly 2, instead of spending time and effort to inspect, disassemble, and re-assemble the toy gun.

Secondly, the electronic fire-control assembly 2 provides multiple operation modes such as single-shot, single-shot-repeated-firing, repeated-firing, and having safety on.

Thirdly, simply through the trough and tenon, the electronic fire-control assembly 2 is locked in the toy gun. The signal conversion board is placed on the bottom near the front of the gear set, and can be easily connected with the power conversion board, power element, driver element. Its assembly and disassembly can be achieved without tools and by ordinary users.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A toy gun, comprising:

a magazine;

a power element;

a driver element electrically connected with the power element;

a gear set engaged by the driver element; and an electronic fire-control assembly electrically connected with the power element, the electronic fire-control assembly controlling the on and off of the driver element which in turn engages the gear set, the electronic fire-control assembly capable of detecting the magazine and responding accordingly;

wherein the electronic fire-control assembly comprises a signal conversion board, at least a microprocessor configured on the signal conversion board, at least a magazine detection module configured in the microprocessor for detecting the state of the magazine, at least a shot selection module configured in the microprocessor, and a trigger on/off module data-linked with the shot selection module.

2. The toy gun according to claim 1, wherein the trigger on/off module interacts with a trigger.

3. The toy gun according to claim 1, wherein the electronic fire-control assembly is housed in an enclosure.

4. The toy gun according to claim 1, further comprising a power conversion board electrically connected with the power element, the driver element, and the fire-control assembly.

5. The toy gun according to claim 1, further comprising a slide and a slide detection switch for detecting the position of the slide.

6. The toy gun according to claim 1, wherein the driver element is a motor.

7. The toy gun according to claim 1, wherein the power element is a battery.

8. The toy gun according to claim 1, wherein the toy gun has a sliding trough inside for the slidable configuration of the electronic fire-control assembly.

9. The toy gun according to claim 8, wherein the toy gun has a tenon inside for locking the electronic fire-control assembly.

* * * * *